US012753573B2

(12) United States Patent
Roberts et al.

(10) Patent No.: US 12,753,573 B2
(45) Date of Patent: Oct. 6, 2026

(54) ADAPTIVE ECO MODE

(71) Applicant: Deere & Company, Moline, IL (US)

(72) Inventors: Kathleen L. S. Roberts, Bettendorf, IA (US); Bradley C. Dauderman, Dubuque, IA (US); Nathan J. Horstman, Peosta, IA (US)

(73) Assignee: Deere & Company, Moline, IL (US)

( * ) Notice: Subject to any disclaimer, the term of this patent is extended or adjusted under 35 U.S.C. 154(b) by 69 days.

(21) Appl. No.: 18/767,730

(22) Filed: Jul. 9, 2024

(65) Prior Publication Data

US 2026/0015820 A1 Jan. 15, 2026

(51) Int. Cl.

| | |
|---|---|
| ***E02F 3/84*** | (2006.01) |
| ***E02F 9/22*** | (2006.01) |
| *E02F 3/76* | (2006.01) |

(52) U.S. Cl.

CPC ..... *E02F 3/841* (2013.01); *E02F 9/2253* (2013.01); *E02F 3/7609* (2013.01); *E02F 9/2292* (2013.01)

(58) Field of Classification Search

CPC ..... E02F 3/841; E02F 9/2253; E02F 3/7609; E02F 9/2292

See application file for complete search history.

(56) References Cited

U.S. PATENT DOCUMENTS

| | | | | |
|---|---|---|---|---|
| 4,745,746 | A * | 5/1988 | Geringer | F16H 61/465 60/449 |
| 2004/0249543 | A1* | 12/2004 | Kilworth | B60W 10/10 701/54 |
| 2012/0173101 | A1* | 7/2012 | Peterson | B60W 30/1882 701/54 |
| 2013/0243556 | A1* | 9/2013 | Shirao | E02F 9/2289 701/50 |
| 2017/0130427 | A1* | 5/2017 | Metzger | E02F 9/2225 |

FOREIGN PATENT DOCUMENTS

| | | | |
|---|---|---|---|
| WO | WO-2018187711 A1 * | 10/2018 | F02D 29/06 |

* cited by examiner

*Primary Examiner* — Kito R Robinson
*Assistant Examiner* — Erin Marie Hartmann
(74) *Attorney, Agent, or Firm* — Taft Stettinius & Hollister LLP; Stephen F. Rost

(57) ABSTRACT

A work machine having an attachment, a frame, an engine, a ground-engaging mechanism, and a hydrostatic transmission operable in an economy mode. The work machine includes a controller to automatically control detection of: an economy mode signal from the hydrostatic transmission and the engine being operable in an economy mode, a grade control signal from the attachment, and an engine load for a designated time period. When the economy mode and the detected grade control signal are active, the controller determines the detected engine load is greater than a maximum load threshold, then a power management parameter is set to a maximum. When the detected engine load is less than the maximum load threshold, then the power management parameter is set to a minimum. If a previous forward pass increased the power management parameter to the maximum, then in a reverse direction of travel, the power management parameter is unchanged.

18 Claims, 5 Drawing Sheets

ADAPTIVE ECO MODE

FIELD OF THE DISCLOSURE

The present disclosure relates to work vehicles and to a system and method that adjusts engine speed in response to a load encountered by an implement of the work vehicle.

BACKGROUND

In the construction industry (and others), various work machines are operated to perform various tasks at a work site. For example, crawler dozers (hereafter "dozers"), motor graders, and other bladed vehicles are well-suited for spreading, shearing, carrying, and otherwise moving relatively large volumes of earth. Typically, on a work machine, an economy mode associated with a hydrostatic transmission is engaged to save fuel and reduce wear and tear on an engine. The economy mode is engaged or activated which then requires less power from the engine.

When an operator switches to economy mode, the engine speed is typically reduced. One problem is that many operators do not engage or switch to the economy mode of operation. Many operators perceive that engaging the economy mode reduces the machine productivity. Although this perception is not accurate since the hydrostatic transmission settings are adjusted to provide the same track speed and the same productivity in economy mode of operation as a non-economy or regular mode of operation of the engine. Many operators do not appreciate that the same productivity can be achieved while using the economy mode of operation so these operators only use the economy mode infrequently or not at all. Therefore, these operators and the fleet of operators do not optimize fuel efficiency and there is increased wear and tear on the engine.

Therefore, a need exists to optimize fuel efficiency and change user perception of the economy mode of operation of the work machine.

SUMMARY

In an illustrative embodiment, a work machine comprising: a frame; an attachment coupled to the frame; an attachment sensor adapted to detect the attachment being active and generate a grade control signal; a ground-engaging mechanism adapted to support the frame; an engine for driving the ground-engaging mechanism and the attachment, the engine coupled through a hydrostatic transmission to the ground-engaging mechanism and the attachment, the hydrostatic transmission including a hydrostatic circuit, the hydrostatic circuit including a pump, wherein the engine and the hydrostatic transmission are operable in an economy mode of operation; a motor adapted to further drive the ground-engaging mechanism; an engine speed sensor adapted to detect an engine speed of the engine and generate an engine speed signal; a controller configured to automatically control: (a) detection of an economy mode signal from the hydrostatic transmission and the engine being operable in an economy mode, (b) detection of a grade control signal from the attachment, and (c) detection of an engine load of the engine for a designated time period; and wherein when the detected mode of operation is economy mode and the detected grade control signal is active, the controller is configured to determine: wherein the detected engine load is greater than or equal to a maximum load threshold for a designated time period, then the controller is configured to set a power management parameter to a maximum power; and wherein when the detected engine load is less than the maximum load threshold for the designated time period, then the controller is configured to set the power management parameter at a minimum power.

In some embodiments, wherein the power management parameter includes one or more of the engine speed, a pump flow of the pump, a motor displacement of the motor, and/or a motor speed of the motor.

In some embodiments, wherein the maximum power of the power management parameter includes any of an increase in the pump flow of the pump, a decrease in the motor displacement of the motor, and/or an increase in the engine speed.

In some embodiments, wherein the maximum power is approximately 1,800 RPM for the engine speed.

In some embodiments, wherein the minimum power is approximately 1,700 RPM for the engine speed.

In some embodiments, wherein the designated time period is between approximately one and five seconds.

In some embodiments, wherein when the engine load is greater than or equal to the maximum load threshold for the designated time period, then the controller is further configured to determine: wherein the detected engine load is less than or equal to a minimum load threshold for a designated time period, then the controller is configured to reduce the power management parameter to a minimum power; and wherein when the detected engine load is greater than the minimum load threshold for the designated time period, then the controller is configured to maintain the power management parameter at the maximum power.

In some embodiments, wherein the minimum load threshold is approximately 50% of the maximum load threshold.

In some embodiments, wherein the minimum load threshold is between approximately 40% and 60% of the maximum load threshold.

In some embodiments, wherein the designated time period is between approximately 1 and 5 seconds.

In some embodiments, wherein the controller is configured to automatically control detection of the motor and/or the ground-engaging mechanism operable in a direction of travel; wherein when the controller detects the direction of travel changes from forwardly to rearwardly, then the controller is further configured to determine a previous power management parameter; and wherein when the previous power management parameter is equal to or greater than the maximum power then the controller is further configured to maintain the power management parameter at the maximum power.

In some embodiments, wherein when the controller determines the previous power management parameter is less than the maximum power, then the controller is further configured to change the power management parameter to the minimum power.

In some embodiments, wherein the controller is configured to determine the engine speed being greater than an anti-stall threshold of the engine, wherein when the engine speed is less than the anti-stall threshold then the controller is configured to automatically increase the power management parameter above the anti-stall threshold.

In some embodiments, wherein the maximum load threshold is about 90% of a peak power of the engine.

In some embodiments, wherein the controller is configured to determine whether the grade control signal is an active signal.

In another illustrative embodiment, a method of adjusting power of a work machine, the method comprising: detecting, by a controller operably engaged with the work machine, an economy mode signal from a hydrostatic transmission and an engine of the work machine being operable in an economy mode; detecting, by the controller, a grade control signal from a grade control sensor associated with an attachment of the work machine; detecting, by the controller, an engine load of the engine for a designated time period; and wherein when the detected mode of operation is economy mode and the detected grade control signal is active, determining, by the controller: when the engine load is greater than or equal to a maximum load threshold for a designated time period, then setting a power management parameter to a maximum power; and when the detected engine load is less than the maximum load threshold for the designated time period, then setting the power management parameter at a minimum power.

In some embodiments, wherein the maximum power is approximately 1,800 RPM for an engine speed of the engine.

In some embodiments, wherein the minimum power is approximately 1,700 RPM for an engine speed of the engine.

In some embodiments, further comprising: automatically detecting, by the controller, the motor and/or the ground-engaging mechanism operable in a direction of travel; wherein when the detected direction of travel changes from forwardly to rearwardly, then determining, by the controller, a previous power management parameter; and wherein when the previous power management parameter is equal to or greater than the maximum power then maintaining by the controller the power management parameter at the maximum power.

In some embodiments, wherein the power management parameter includes one or more of the engine speed, a pump flow of the pump, a motor displacement of the motor, and/or a motor speed of the motor.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

As used herein, the term controller refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of work machines, and that the crawler dozer described herein is merely one exemplary embodiment of the present disclosure.

For the sake of brevity, conventional techniques related to signal processing, data transmission, signaling, control, and other functional aspects of the system (and the individual operating components of the systems) may not be described in detail herein. Furthermore, the connecting lines shown in the various figures contained herein are intended to represent example functional relationships and/or physical coupling between the various elements. It should be noted that many alternative or additional functional relationships or physical connections may be present in an embodiment of the present disclosure.

Discussion herein may focus on the exemplary embodiment and method of a crawler dozer. In other applications of the disclosed system and method, other configurations are also possible. For example, work machines in some embodiments may be configured as various work machines with attachments such as motor graders, skid-steer loaders or similar machines. Further, work machines may be configured as machines other than construction vehicles, including machines from agriculture, forestry and mining industries, such as tractors.

Figure 1:
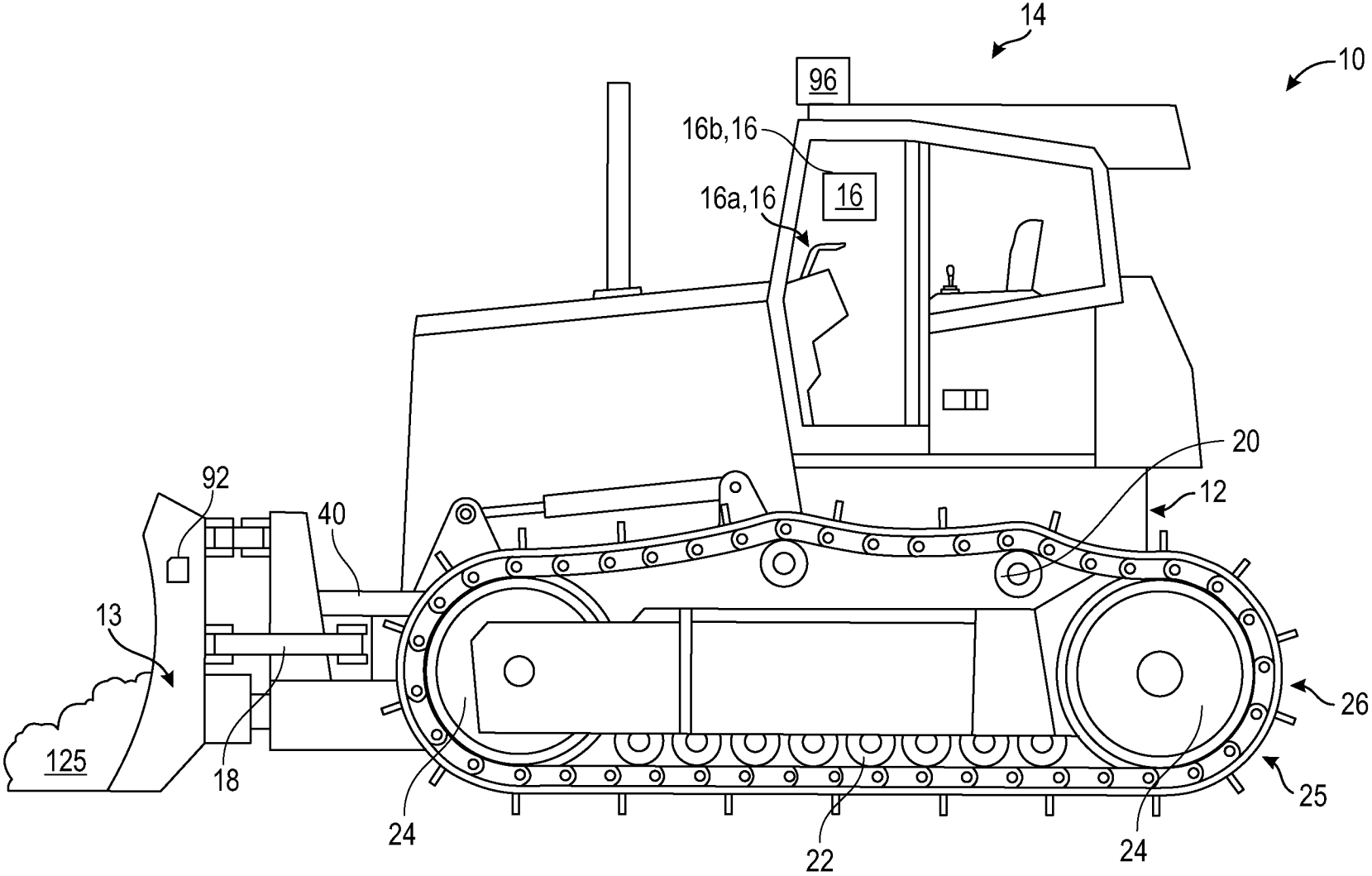
FIG. 1 is a side view of an exemplary embodiment of a crawler dozer.

FIGS. 1 and/or 2 illustrate the work machine 10 (hereinafter also referred to as a "crawler dozer") including a frame 12, an attachment 13 coupled to the frame 12, a cab 14 supported by the frame 12, and a number of operator controls 16 located within the cab 14. The operator controls 16 includes one or more joysticks, such as the joystick 16*a*, various switches or levers, one or more buttons, a touch-screen interface 16*b* that may be overlaid on a display, a keyboard, a speaker, a microphone associated with a speech recognition system, control pedals, or various other human-machine interface devices. The operator may actuate one or more devices of operator controls 16 for purposes of operating the crawler dozer 10.

A ground-engaging mechanism 26 may be adapted to support the frame 12. The ground-engaging mechanism 26 may contain top rollers 20, bottom rollers 22, sprockets and/or idlers 24, and twin tracks 25. In further embodiments, the ground-engaging mechanism 26 can be replaced by a different type of mechanism including wheels, friction or positively-driven belts, or another mechanism suitable for moving the crawler dozer 10 across a tract of land, such as off-road terrain. The attachment 13 may comprise of a blade including a lower cutting edge. The attachment 13 may be mounted to a forward portion of the frame by an outer control linkage 18, which is constructed of various links, joints, and other structural elements. The linkage 18 may include, for example, a push frame joined to the frame 12 at pivot points. A blade actuation system 40, the components of which may be generally interspersed or integrated with the components of the outer control linkage 18. The blade actuation system 40 can include any number and type of actuators suitable for enabling an operator of the crawler dozer 10 to control the position of the blade or attachment 13 relative to the frame 12.

Figure 2:
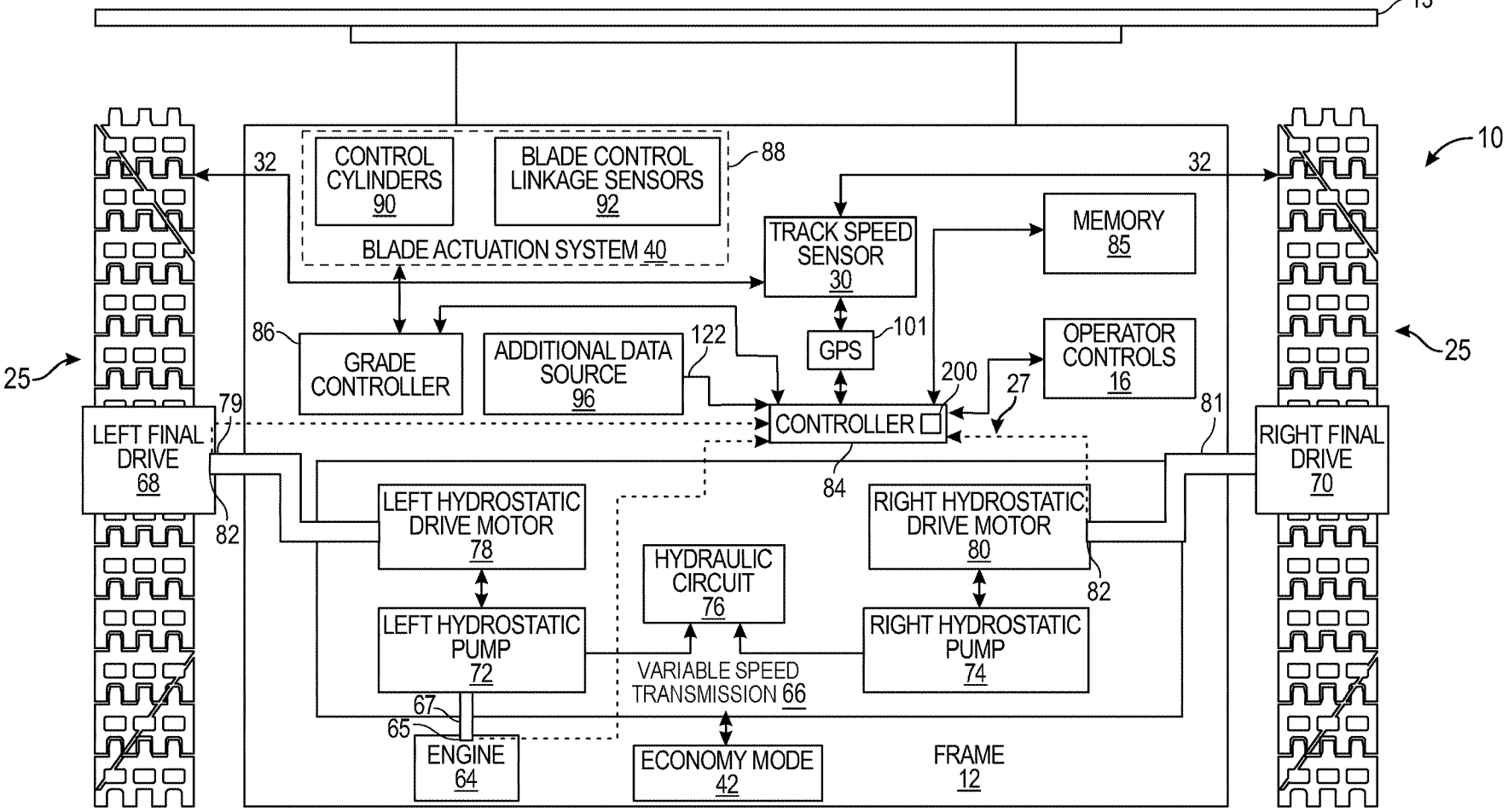
FIG. 2 is a schematic of the crawler dozer, according to one embodiment shown in FIG. 1.

Advancing now to FIGS. 2 and/or 3 with continued to reference to FIG. 1, a schematic of the exemplary crawler dozer 10 is shown. Here it can be seen that the crawler dozer 10 includes a number of additional components beyond those previously described in FIG. 1. Such additional components, for example, can include an engine 64 for driving the ground-engaging mechanism 26 and positioning of the attachment 13 relative to the frame 12. The engine 64 may be coupled through a variable speed transmission 66 to the ground-engaging mechanism 26 (i.e. in this embodiment, a left final drive 68, and a right final drive 70 with tracks 25) and the attachment 13. The variable speed transmission 66 may include a hydrostatic circuit 76. The hydrostatic circuit 76 may include a pump (i.e. a left hydrostatic pump 72, a right hydrostatic pump 74). During operation of the crawler dozer 10, the engine 64 drives rotation of the track 25 through the variable speed transmission 66 and the final drives (68, 70). In one example, the rotating mechanical output of the engine 64 drive left and right hydrostatic pumps (72, 74) that may be included within the variable speed transmission 66. The hydrostatic pumps (72, 74) are fluidly interconnected through other fluid-conducting components in the hydrostatic circuit 76, such as filters, reservoirs, heat exchangers, and the like.

A motor (in this embodiment, a left hydrostatic motor 78, a right hydrostatic motor 80) may be adapted further drive the ground-engaging mechanism 26. The hydrostatic pumps 72, 74 are further fluidly coupled to and drive the motor (78, 80) contained with the variable speed transmission 66. The mechanical output shafts (79, 81) of the motors (78, 80) then drive rotation of the tracks 25 through the final drives (68, 70). The engine 64 and the power train of the crawler dozer 10 may vary in other embodiments. One or more motor sensors 82 may be further included in the motor (78, 80). The motor sensors 82 each include a sensor for monitoring the speed of the respective shaft (79, 81) of the motors (78, 80). During operation of the crawler dozer 10, the motor sensors 82 may observe the output shafts 79, 81 associated with the motor 78, 80 and generate motor sensor signals 27 or sensor data based thereon, which is communicated to the controller 84 onboard the crawler dozer 10.

A track speed sensor 30 may be adapted to detect a track speed 32 of the ground-engaging mechanism 26 and generate a track speed signal 34. A track speed sensor 30 observes a track speed of the work machine 10, such as rotation of the ground-engaging mechanism 26 (or tracks 25, or components thereof) associated with the work machine 10. The track speed sensor may further be coupled to a global positioning system 101, a sensor associated with the ground speed or velocity of the work machine 10 and generate track speed signal 34 based thereon, which may be received and processed by the controller 84 to determine a track speed 32 of the work machine 10. The work machine track speed 32 may differ from a ground speed of the work machine due to slip in the tracks.

At least one engine speed sensor 65 is associated with the engine 64. An engine speed sensor 65 observes an operational speed of the engine 64, such as a rotation speed of an output shaft 67 associated with the engine 64 and generates engine sensor signals based thereon, which may be received and processed by the controller 84 to determine a speed of the engine 64. That is, the engine speed sensor 65 may be adapted to detect an engine speed and generate an engine speed signal 52.

The one or more controllers 84 are schematically represented in FIG. 2 by a single block 84 although the controller 84 can include any number of processing devices, which can be distributed throughout the crawler dozer 10 and interconnected utilizing different communication protocols and memory architectures. The controller 84 (or others) may be configured as a computing device with associated processor devices and memory architectures 85, as a hard-wired computing circuit (or circuits), as a programmable circuit, as a hydraulic, electrical or electro-hydraulic controller, or otherwise. As such, the work vehicle controller 84 may be configured to execute various computational and control functionality with respect to the crawler dozer 10 (or other machinery). In some embodiments, the controller 84 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 84 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The work vehicle controller 84 may be in electronic, hydraulic, mechanical, or other communication with various other systems or devices of the crawler dozer 10 (or other machinery). For example, the work vehicle controller 84 may be in electronic or hydraulic communication with various actuators, sensors, and other devices within (or outside of) the crawler dozer 10, including various devices associated with the hydrostatic pumps 72, 74, hydrostatic circuit 76, engine speed sensor 65, a grade control system ("GCS") 88, hydrostatic motors 78, 80, hydrostatic drive motor sensors 82, blade control linkage sensors 92, additional data sources 96 and so on. The work vehicle controller 84 may communicate with other systems or devices in various known ways, including via a CAN bus (not shown) of the crawler dozer 10, via wireless or hydraulic communication means, or otherwise. An example location for the work vehicle controller 84 is depicted in FIGS. 1 and 2. It will be understood, however, that other locations are possible including other locations on the crawler dozer 10, or various remote locations. The work vehicle controller 84 receives input commands and interacts with the operator via the operator controls 16, such as the throttle control knob, the joystick 16*a* and the touchscreen 16*b*.

The crawler dozer 10 further includes the blade actuation system 40. In one example, the blade actuation system 40 is controlled by a grade controller 86 of the GCS 88. The blade actuation system 40 contains a number of blade control linkage cylinders 90 and blade control linkage sensors 92. The blade control linkage cylinders 90 can include hydraulic lift cylinders and hydraulic pitch cylinders (not illustrated). The grade controller 86 is further operably coupled to the blade control linkage cylinders 90 and can transmit commands thereto. The grade controller 86 may transmit such commands to the blade control linkage cylinders 90 in accordance with operator input received via the operator controls 16 and communicated to the grade controller 86 by the work vehicle controller 84, or in response to automatic blade adjustments determined by the grade controller 86 of the GCS 88.

The blade control linkage sensors 92 observe a condition associated with the blade 13, for example, a position of the blade 13, such as a pitch and a height of the blade 13 relative to gravity, and generate sensor signals or sensor data based on the observation. The blade control linkage sensors 92 communicate these sensor signals to the grade controller 86, which processes these sensor signals and outputs data for the work vehicle controller 84. Generally, the blade control linkage sensors 92 may include various different combinations of force sensors (e.g., load cells) for measuring the forces applied through the blade 13 and the blade control linkage 18, positional sensors (e.g., magnetostrictive linear position sensors) for measuring the stroke of any or all of the blade control linkage cylinders 90, vibration sensors, wear sensors, and/or various other sensors for monitoring the operational parameters of the blade actuation system 40, including one or more cameras, depth sensors, etc. In one example, the blade control linkage sensors 92 comprise one or more inertial measurement units (IMUs) that observe a linear and an angular position of the blade 13 relative to gravity and generate sensor signals based thereon.

The grade controller 86 of the GCS 88 may be configured as a computing device with associated processor devices and memory architectures, as a hard-wired computing circuit (or circuits), as a programmable circuit, as a hydraulic, electrical or electro-hydraulic controller, or otherwise. As such, the grade controller 86 may be configured to execute various computational and control functionality with respect to the crawler dozer 10 (or other machinery). In some embodiments, the grade controller 86 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the grade controller 86 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements. The grade controller 86 may be in electronic, hydraulic, mechanical, or other communication with various other systems or devices of the crawler dozer 10 (or other machinery). For example, the grade controller 86 may be in electronic or hydraulic communication with various actuators, sensors, and other devices within (or outside of) the crawler dozer 10, including the Global Positioning System (GPS) 101, the blade control linkage cylinders 90 and the blade control linkage sensors 92. The grade controller 86 may communicate with other systems or devices in various known ways, including via a CAN bus (not shown) of the crawler dozer 10, via wireless or hydraulic communication means, or otherwise. An example location for the grade controller 86 is depicted in FIG. 2. It will be understood, however, that other locations are possible including other locations on the crawler dozer 10, or various remote locations. The grade controller 86 is in communication with the work vehicle controller 84 over a suitable communication architecture, such as the CAN bus associated with the crawler dozer 10.

The work vehicle controller 84 may also receive data inputs from additional data sources 96, which are further coupled to one or more inputs of the work vehicle controller 84 and which can be distributed across the infrastructure of the example crawler dozer 10. The additional data sources 96 can include any number of sensors generating data that may be utilized by the work vehicle controller 84 in performing embodiments of the below-described load control system 200. In one example, one or more of these sensors are associated with the GCS 88. For example, such additional data sources 96 can include, for example, crawler dozer position data and ground speed data received from the GPS 101 connected to the crawler dozer 10. The additional data sources 96 also include an active signal, which may be received by the work vehicle controller 84 when the GCS 88 is actively controlling the movement of the blade 13.

In addition, the work vehicle controller 84 can receive one or more inputs from the operator controls 16. For example, the operator controls 16 includes the throttle control knob, and a throttle control sensor may observe a rotary position of the throttle control knob and generate sensor signals or sensor data based on the observation. The throttle control sensor is generally a rotary position sensor, including, but not limited to, a rotary encoder and so on.

Figure 3:
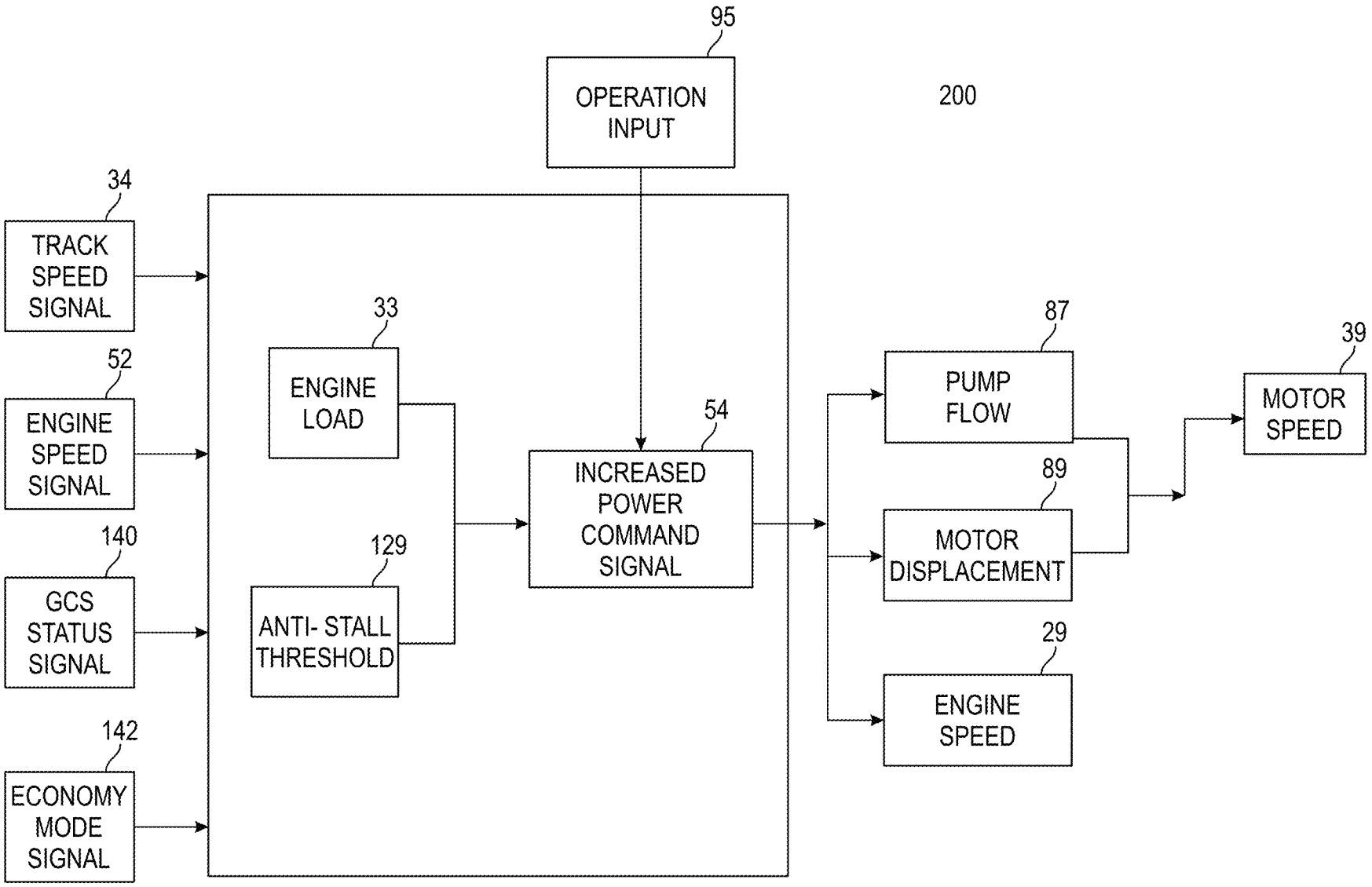
FIG. 3 is a dataflow diagram illustrating an example system for the work machine of FIG. 1 according to various embodiments.

Referring to FIGS. 1, 2, and 3, in a system 200, the controller 84 may be adapted to send an increased power command signal 54 based on one or more of the track speed signal 34, the engine speed signal 52, a GCS status signal 140, and an economy mode signal 142 that cause the work machine 10 to receive an increased engine load 33. Further, the work machine 10 is configured to move in a forward direction of travel for the work machine 10. The track speed signal 34 corresponds to the sensor signals or sensor data from each of the hydrostatic drive motor sensors 82 and determine the track speed. The engine speed signal 52 corresponds to the sensor signals or sensor data from the engine 64 and determine the engine speed. The GCS status signal 140 is an active signal received from the grade controller 86. The active signal indicates that the GCS 88 is active. As used herein, the GCS 88 is "active" when the GCS 88 is moving and/or positioning the blade 13 and engaging a payload 125, grading or cutting the ground surface, lifting or carrying any portion of the payload 125, spreading any load being carried by the blade 13, and/or any other blade parameter that indicates the blade 13 has engaged and/or is retaining an object such as dirt. The economy mode signal 142 corresponds to an active signal from an economy mode 42 mechanism being engaged wherein the work machine 10 and in particular the variable speed transmission 66 and the engine 64 are operable in an economy mode of operation.

The increased power command signal 54 increases a power management parameter to compensate for an increase in the engine load 33. Some of the power management parameters include an engine speed 29, a pump flow 87, a motor displacement 89, and/or a motor speed 39. The increased power command signal 54 may cause one or more of an increase in pump flow 87 and/or a decrease in motor displacement 89. The increased power command signal 54 may cause an increase in the engine speed 29. The increased power command signal 54 may occur at or immediately after the increase in the engine load 33. Note the increase in the engine load 33 may be sudden, gradual, anticipated, or detected, to name a few. The controller 84, advantageously uses the increased power command signal 54 to accommodate the increased load on the work machine 10 without disengaging the economy mode 42 of operation of the work machine 10, thereby improving the fuel savings and economy and maintaining productivity of the work machine 10 for the operator.

An operator interface control 16 may be adapted to receive an operator input. Generally, the operator interface control 16 may include one or more joysticks, such as the joystick 16*a* (shown in FIG. 1), various switches or levers, one or more buttons, a touchscreen interface 16*b* (shown in FIG. 1) that may be overlaid on a display, a keyboard, a speaker, a microphone associated with a speech recognition system, control pedals, or various other human-machine interface devices. The operator may actuate one or more devices of operator interface control 16 for purposes of operating the crawler dozer 10, and for providing operator input 95 to the system 200 for operating the attachment 13 and the method 400 outlined in the disclosure and FIG. 5.

The change in any of the track speed signal 34, the engine speed signal 52, and/or the GCS status signal 140 may additionally or alternatively be anticipated through data inputs 122 from a sensory device 96 (as shown in FIG. 1) coupled to the work machine 10 which, are further coupled to one or more inputs of the controller 84 and which can be distributed across the infrastructure of the work machine 10. The sensory device 96 may include any number of sensors generating data that may be utilized by the work vehicle controller 84 in performing embodiments of the above-mentioned system 200 for compensating increased engine speed 29 because of increased engine load 33. In one example, one or more of these sensory devices 96 associated system may include one or more of a forward facing camera, lidar, radar, sonar, piezoelectric feedback, load sensor coupled to the attachment 13, GPS to determine track speed, to name a few. The sensory device 96 may also be adapted to detect load applied to the blade 13.

The increased power command signal 54 may only apply when the engine speed signal 52 is above an anti-stall threshold 129, the anti-stall threshold 129 referring to a minimum engine speed for the engine speed signal 52 required to keep the engine 64 on the work machine 10 from stalling. Upon reaching the engine speed signal 52 below or less than the anti-stall threshold 129, the power command signal 54 may cease to increase.

Figure 4:
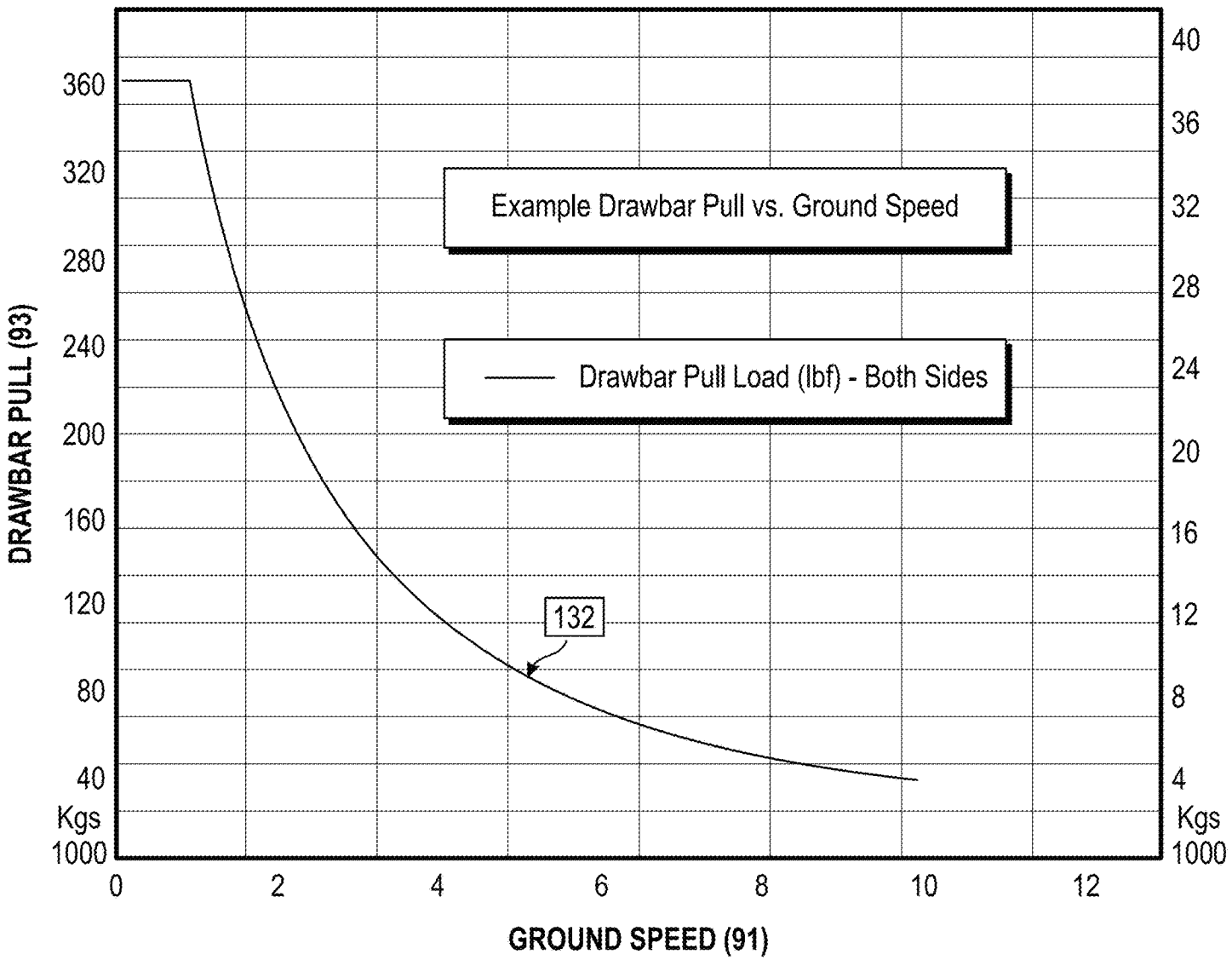
FIG. 4 is an exemplary drawbar pull-ground speed curve.

Now referring to FIG. 4, an exemplary drawbar pull-ground speed curve 132 is shown. The drawbar pull 93 generally refers to the maximum force exerted by the work machine 10 relative to the ground speed of the ground-engaging mechanism 26. The ground speed curve 132 represents the relationship between the ground speed 91 or how fast the work machine 10 moves and RPM or engine speed 29 of the engine 64. The curve 132 shows the maximum force exerted relative to ground speed and the work machine 10 can operate at any point on or under the curve 132. For example, for the hydrostatic transmission 66, the operator can set a desired maximum ground speed and the power command signal 54 adjusts the engine speed 29 or RPM to maintain efficiency. As the ground speed 91 increases, the engine speed 29 or RPM may vary to optimize performance. The ground speed curve 132 ensures that the work machine 10 operates efficiently across different speeds and loads.

Figure 5:
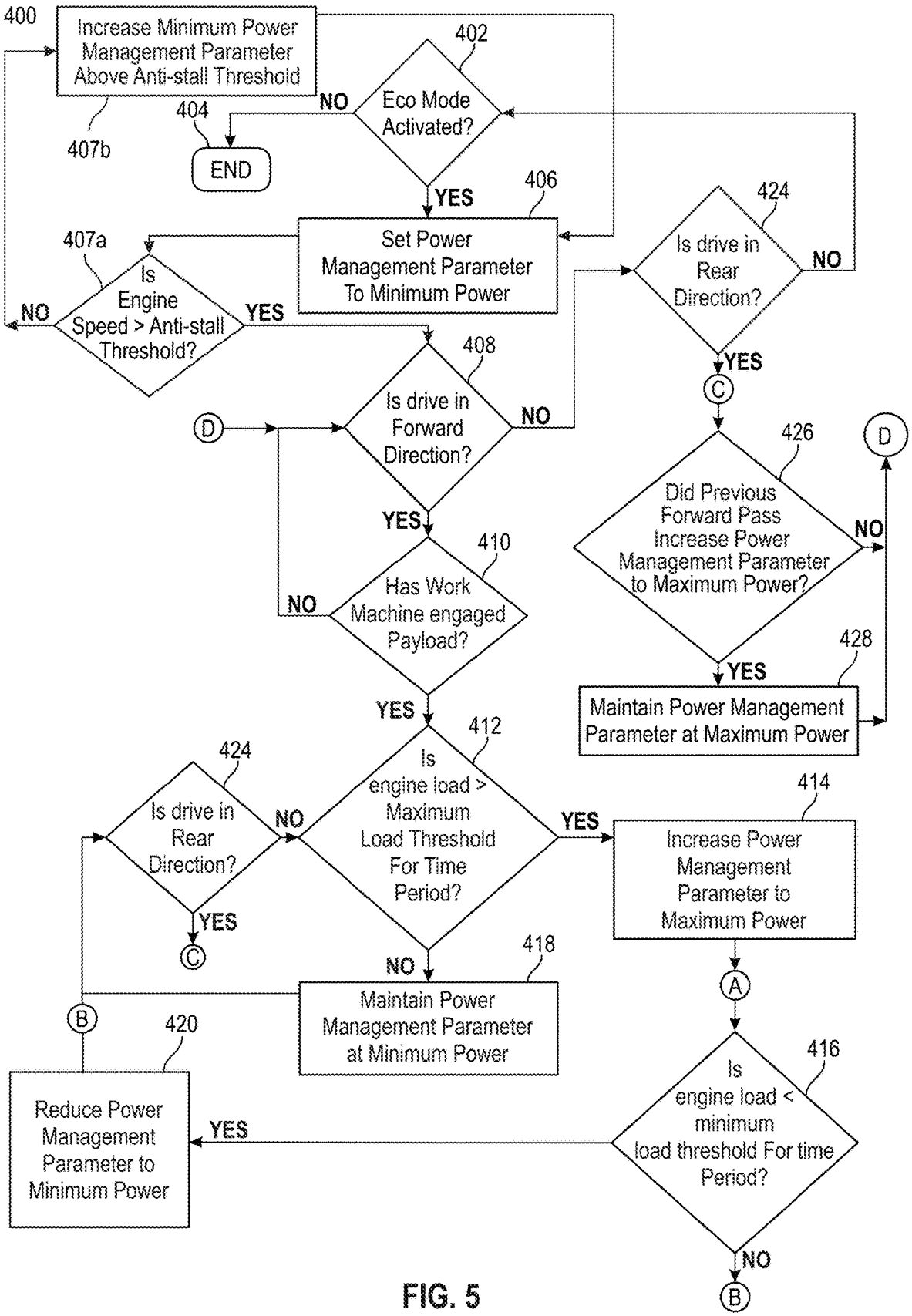
FIG. 5 is a flow chart for a method of operating the system in FIG. 2 for the exemplary embodiment in FIG. 1, according to one embodiment.

Now turning to FIG. 5, a method 400 of compensating one or more power parameters due to a change in the engine load 33 for the work machine 10 is shown. In one example, the method 400 begins at step 402. At step 402, the method 400 determines by the controller 84 of the work machine 10, if the economy mode signal 142 is active indicating the work machine 10 is operating in the economy mode of operation. If the economy mode signal 142 is not active, then the method 400 ends at step 404.

If the economy mode signal 142 is active, then the method 400 continues by the controller 84 of the work machine 10, to step 406 to set a power management parameter to a minimum power. In one embodiment the power management parameter includes the engine speed signal 52 of the engine 64 and the minimum power is 1,700 RPM for the engine 64. In this embodiment, the method 400 determines by the controller 84 of the work machine 10, if the engine speed signal 52 is above the anti-stall threshold 129 in step 407*a*. If the engine speed signal 52 is above the anti-stall threshold 129, the method proceeds to step 408. Otherwise, the controller 84 of the work machine 10 operates to increase the minimum power of the power management parameter above the anti-stall threshold 129 in step 407*b*. In other embodiments the minimum power is less than 1,700 RPM or the minimum power may be higher than 1,700 RPM for the engine speed 29. Other power management parameters include the pump flow 87 for the pumps 72, 74, the motor displacement 89 for the motors 78, 80, and/or the motor speed 39 for the motors 78, 80.

At step 408, the method 400 determines by the controller 84 of the work machine 10, whether the drive motors 78, 80 are configured for operation in a forward direction of travel for the work machine 10. If the drive motors 78, 80 are operable in a forward direction of travel for the work machine 10, then the method 400 proceeds to step 410. If the drive motors 78, 80 are not operable in a forward direction of travel for the work machine 10, then the method 400 proceeds to step 424.

At step 410, the method 400 determines by the controller 84 of the work machine 10, whether the GCS 88 is "active" and/or whether the attachment 13 has engaged the payload 125 as previously described. If the controller 84 determines that the GCS status signal 140 is not active, then the method 400 returns to step 408 as previously described. If the controller 84 determines that the GCS status signal 140 is active, then the method 400 proceeds to step 412.

At step 412, the method 400 determines by the controller 84 of the work machine 10, whether the engine load 33 is greater than a maximum load threshold for a designated time period. The maximum load threshold is a maximum percent of a peak power of the engine 64. In one embodiment, the maximum percent is 90% of the peak power of the engine 64. In other embodiments, the maximum percent may be more or less than 90%. The designated time period typically ranges from 1 to 5 seconds or from 2 to 4 seconds. In other embodiments, the designated time period but can be any desired time. If the controller 84 determines that the engine load 33 is greater than the maximum load threshold for the designated time period, then the method 400 proceeds to step 414. If the controller 84 determines that the engine load 33 is less than the maximum load threshold for the designated time period, then the method 400 proceeds to step 418.

At step 418, the method 400 determines by the controller 84 of the work machine 10, that the power management parameter is maintained at the minimum power as previously described. The method 400 continues to step 424.

At step 414, the method 400 determines by the controller 84 of the work machine 10, that the power management parameter is increased to a maximum power. As the power management parameter is increased to the maximum power, the operator will notice the engine speed 29 has increased which will indicate that the working machine 10 is working harder and will have the power the operator desires for productivity. In one embodiment the power management parameter includes the engine speed signal 52 of the engine 64 and the maximum power is 1,800 RPM for the engine 64. In other embodiments the maximum power is less than 1,800 RPM or the maximum power may be higher than 1,800 RPM such as 1,900 RPM. The method 400 continues to step 416.

At step 416, the method 400 determines by the controller 84 of the work machine 10, whether the engine load 33 is less than a minimum load threshold for a designated time period. For example, in one embodiment, the minimum load threshold corresponds to a reduction in the load on the attachment 13. One exemplary situation is the work machine 10 operating to spread piles of dirt or other material wherein the work machine 10 has a high load or amount of material initially on the attachment 13, but then over time as the work machine 10 spreads the material and the material leaves and falls off the attachment 13, then the load decreases over time and the engine load 33 also decreases. The minimum load threshold is a minimum percent of a peak power of the engine 64. The designated time period typically ranges from 1 to 5 seconds, but can be set at any desired time. If the controller 84 determines that the engine load 33 is less than the minimum load threshold for the designated time period, then the method 400 proceeds to step 420. If the controller 84 determines that the engine load 33 is greater than the minimum load threshold for the designated time period, then the method 400 proceeds to step 424.

At step 420, the method 400 determines by the controller 84 of the work machine 10, to reduce the power management parameter to the minimum power as previously described.

At step 424, the method 400 determines by the controller 84 of the work machine 10, if the drive motors 78, 80 are operable in a rearward direction of travel for the work machine 10. If the drive motors 78, 80 are not operable in the rearward direction of travel then the method 400 proceeds to step 402. If the drive motors 78, 80 are operable in the rearward direction of travel then the method 400 proceeds to step 426.

At step 426, the method 400 determines by the controller 84 of the work machine 10, if a previous forward pass operation of the work machine 10 increase the power management parameter to the maximum power. The forward pass operation of the work machine 10 includes the work machine 10 traveling in a forward direction. If the method determines by the controller 84 of the work machine 10, that the previous forward pass operation of the work machine 10 did not increase the power management parameter to the maximum power, the method 400 continues to step 408. If the method determines by the controller 84 of the work machine 10, that the previous forward pass operation of the work machine 10 did increase the power management parameter to the maximum power, the method 400 continues to step 428.

At step 428, the method 400 determines by the controller 84 of the work machine 10, to maintain the power management parameter at the maximum power.

Beneficially, the method 400 determines a repetitive high or heavy load condition for the work machine 10 such as at the end of a pushing operation or at the beginning of a pushing operation for the attachment 13. The method 400 predicts whether the operator is going to repeat the heavy loading condition, i.e., exceed the maximum load threshold for the designated time period, and then the method 400 tailors the power management parameter accordingly. The method 400 increases the productivity of the work machine 10 by varying the power management parameter including increasing the engine speed 29. The method 400 also determines whether the heavy loading condition no longer exists such that the power management parameter includes decreasing the engine speed 29. Some of the benefits of method 400 for the work machine 10 include fuel savings or fuel reduction, increased productivity, and increased longevity of the working machine 10 both individually and collectively for the fleet or the enterprise.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A work machine comprising:

a frame;

an attachment coupled to the frame;

an attachment sensor adapted to detect the attachment being active and generate a grade control signal;

a ground-engaging mechanism adapted to support the frame;

an engine for driving the ground-engaging mechanism and the attachment, the engine coupled through a hydrostatic transmission to the ground-engaging mechanism and the attachment, the hydrostatic transmission including a hydrostatic circuit, the hydrostatic circuit including a pump, wherein the engine and the hydrostatic transmission are operable in an economy mode of operation;

a motor adapted to further drive the ground-engaging mechanism;

an engine speed sensor adapted to detect an engine speed of the engine and generate an engine speed signal;

an engine load sensor adapted to generate an engine load signal; and a controller comprising a processor and a memory storing instructions which, when executed by the processor, cause the controller to automatically control: (a) detection of an economy mode signal from the hydrostatic transmission and the engine being operable in the economy mode of operation, (b) detection of a grade control signal from the attachment, and (c) detection of an engine load of the engine from the engine load signal for a designated time period that is fixed and stored in the memory, wherein the designated time period is a single constant value that does not vary based on an operating mode of the controller or historical operation of the work machine; and wherein when the detected economy mode signal is active and the detected grade control signal is active, the controller is configured to determine:

wherein the detected engine load is greater than or equal to a maximum load threshold for the designated time period, then the controller is configured to set a power management parameter comprising at least one of the engine speed, pump flow of the pump, motor displacement of the motor, and motor speed of the motor to a maximum power; and wherein when the detected engine load is less than the maximum load threshold for the designated time period, then the controller is configured to set the power management parameter at a minimum power, and, during operation with the power management parameter set at the minimum power and the grade control signal is active, the controller is further configured to compares the engine speed signal to an anti-stall threshold stored in the memory and, when the engine speed is less than the anti-stall threshold, automatically increase at least one of the engine speed and a flow output of the pump to raise the engine speed above the anti-stall threshold while maintaining the economy mode of operation.

2. The work machine of claim 1, wherein the maximum power of the power management parameter includes any of an increase in the pump flow of the pump, a decrease in the motor displacement of the motor, and/or an increase in the engine speed.

3. The work machine of claim 1, wherein the maximum power is 1,800 RPM for the engine speed.

4. The work machine of claim 1, wherein the minimum power is 1,700 RPM for the engine speed.

5. The work machine of claim 1, wherein the designated time period is between one and five seconds.

6. The work machine of claim 1, wherein when the engine load is greater than or equal to the maximum load threshold for the designated time period, then the controller is further configured to determine:

wherein when the detected engine load is less than or equal to a minimum load threshold for the designated time period, then the controller is configured to reduce the power management parameter to the minimum power; and wherein when the detected engine load is greater than the minimum load threshold for the designated time period, then the controller is configured to maintain the power management parameter at the maximum power.

7. The work machine of claim 6, wherein the minimum load threshold is 50% of the maximum load threshold.

8. The work machine of claim 6, wherein the minimum load threshold is between 40% and 60% of the maximum load threshold.

9. The work machine of claim 6, wherein the designated time period is between 1 and 5 seconds.

10. The work machine of claim 1, wherein the controller is configured to automatically detect the motor and/or the ground-engaging mechanism operable in a direction of travel;

wherein, when the controller detects the direction of travel changes from forwardly to rearwardly, then the controller is further configured to determine a stored forward-direction power management parameter that was set while the work machine was previously traveling in the forwardly direction of travel; and wherein, when the stored forward-direction power management parameter is equal to or greater than the maximum power, then the controller is further configured to maintain the power management parameter at the maximum power.

11. The work machine of claim 10, wherein when the controller determines that the stored forward-direction power management parameter is less than the maximum power, then the controller is further configured to change the power management parameter to the minimum power.

12. The work machine of claim 1, wherein the controller is configured to determine the engine speed being greater than the anti-stall threshold, then the controller is configured to automatically increase the power management parameter above the anti-stall threshold.

13. The work machine of claim 1, wherein the maximum load threshold is 90% of a peak power of the engine.

14. The work machine of claim 1, wherein the controller is configured to determine whether the grade control signal is an active signal.

15. A method of adjusting power of a work machine, the method comprising:

detecting, by a controller including a processor and a memory storing instructions which, when executed by the processor, cause the controller to control the work machine, the controller operably engaged with the work machine, an economy mode signal from a hydrostatic transmission and an engine of the work machine being operable in the economy mode of operation;

detecting, by the controller, a grade control signal from a grade control sensor associated with an attachment of the work machine;

detecting, by the controller, an engine load of the engine from an engine load signal from an engine load sensor for a designated time period that is fixed and stored in the memory, wherein the designated time period is a single constant value that does not vary based on an operating mode of the controller or historical operation of the work machine; and wherein when the detected economy mode signal is active and the detected grade control signal is active, determining, by the controller:

when the engine load is greater than or equal to a maximum load threshold for the designated time period, then setting a power management parameter including at least one of the engine speed of the engine, a pump flow of a pump of the hydrostatic transmission, a motor displacement of a motor of the hydrostatic transmission, and a motor speed of the motor to a maximum power; and when the detected engine load is less than the maximum load threshold for the designated time period and the grade control signal is active, then setting the power management parameter at a minimum power; and while the power management parameter is set at the minimum power, comparing, by the controller, the engine speed signal of the engine to an anti-stall threshold stored in the memory and, when the engine speed is less than the anti-stall threshold, increasing, by the controller, at least one of the engine speed and the pump flow to raise the engine speed above the anti-stall threshold while maintaining the economy mode of operation.

16. The method of claim 15, wherein the maximum power is 1,800 RPM for the engine speed of the engine.

17. The method of claim 15, wherein the minimum power is 1,700 RPM for the engine speed of the engine.

18. The method of claim 15, further comprising:

automatically detecting, by the controller, the motor and/or the ground-engaging mechanism operable in a direction of travel;

wherein when the detected direction of travel changes from forwardly to rearwardly, then determining, by the controller, a stored forward-direction power management parameter that was set while the work machine was previously traveling in the forward direction; and wherein when the stored forward-direction power management parameter is equal to or greater than the maximum power, then maintaining by the controller the power management parameter at the maximum power.

* * * * *